US008291986B2

(12) United States Patent
Gorrara et al.

(10) Patent No.: US 8,291,986 B2
(45) Date of Patent: Oct. 23, 2012

(54) EXPANDABLE LINER HANGER

(75) Inventors: Andrew Gorrara, Stonehaven (GB); Peter Wood, Aberdeenshire (GB); Paul Hazel, Aberdeenshire (GB); Fraser Louden, Aberdeen (GB)

(73) Assignee: Meta Downhole Limited, Aberdeen (GB)

( * ) Notice: Subject to any disclaimer, the term of this patent is extended or adjusted under 35 U.S.C. 154(b) by 283 days.

(21) Appl. No.: 12/226,490

(22) PCT Filed: Apr. 13, 2007
(Under 37 CFR 1.47)

(86) PCT No.: PCT/GB2007/001369

§ 371 (c)(1),
(2), (4) Date: Jun. 4, 2009

(87) PCT Pub. No.: WO2007/119052

PCT Pub. Date: Oct. 25, 2007

(65) Prior Publication Data

US 2010/0147535 A1 Jun. 17, 2010

(30) Foreign Application Priority Data

Apr. 18, 2006 (GB) ..... 0670551.9

(51) Int. Cl.
*E21B 23/00* (2006.01)

(52) U.S. Cl. ..... 166/382; 166/207; 166/208; 166/212

(58) Field of Classification Search ..... 166/382, 166/208, 380, 120, 206, 207, 212, 217, 277
See application file for complete search history.

(56) References Cited

U.S. PATENT DOCUMENTS

| | | | | |
|---|---|---|---|---|
| 5,311,661 | A * | 5/1994 | Zifferer | 29/890.053 |
| 5,355,968 | A * | 10/1994 | Smith | 175/320 |
| 5,743,301 | A | 4/1998 | Winship | |
| 6,415,863 | B1 * | 7/2002 | Hudson et al. | 166/208 |
| 6,702,029 | B2 * | 3/2004 | Metcalfe et al. | 166/378 |
| 6,745,841 | B2 * | 6/2004 | Abercrombie Simpson | 166/380 |
| 6,799,632 | B2 * | 10/2004 | Hall et al. | 166/207 |
| 6,821,147 | B1 * | 11/2004 | Hall et al. | 439/581 |
| 6,877,567 | B2 * | 4/2005 | Hirth | 166/382 |
| 6,976,539 | B2 * | 12/2005 | Metcalfe et al. | 166/378 |
| 7,128,147 | B2 * | 10/2006 | Marcin et al. | 166/208 |
| 7,255,177 | B2 * | 8/2007 | Duggan et al. | 166/380 |
| 7,290,616 | B2 * | 11/2007 | Cook et al. | 166/380 |

(Continued)

FOREIGN PATENT DOCUMENTS

| | | |
|---|---|---|
| WO | WO 00/37772 | 6/2000 |

(Continued)

*Primary Examiner* — Jennifer H Gay
*Assistant Examiner* — Tamatane Aga
(74) *Attorney, Agent, or Firm* — Drinker Biddle & Reath LLP

(57) ABSTRACT

A downhole expandable liner hanger apparatus for extending the length of an existing tubular such as a casing or liner string is described. The apparatus comprises a tubular portion and a securing and/or sealing means for securing the tubular portion to the existing tubular such as a casing string to thereby extend the length of the existing tubular and preferably simultaneously provide a sealed coupling between the tubular portion and the existing tubular. A first part or a length of the tubular portion preferably comprises a first sidewall thickness and a second part or length of the tubular portion is located adjacent the first part, where the second part comprises a second sidewall thickness, said first sidewall thickness being less than the second sidewall thickness.

38 Claims, 8 Drawing Sheets

U.S. PATENT DOCUMENTS

| | | | | |
|---|---|---|---|---|
| 7,357,190 | B2 * | 4/2008 | Cook et al. | 166/380 |
| 7,367,391 | B1 * | 5/2008 | Stuart et al. | 166/208 |
| 7,367,404 | B2 * | 5/2008 | Simpson et al. | 166/380 |
| 7,413,021 | B2 * | 8/2008 | Madhavan et al. | 166/380 |
| 7,419,193 | B2 * | 9/2008 | Simpson | 285/382.4 |
| 7,779,910 | B2 * | 8/2010 | Watson | 166/208 |
| 7,854,266 | B2 * | 12/2010 | Watson | 166/380 |
| 7,859,426 | B2 * | 12/2010 | Clark et al. | 340/854.4 |
| 2002/0079101 | A1 * | 6/2002 | Baugh et al. | 166/285 |
| 2003/0127222 | A1 * | 7/2003 | Marcin et al. | 166/208 |
| 2004/0020659 | A1 * | 2/2004 | Hall et al. | 166/380 |
| 2004/0150532 | A1 * | 8/2004 | Hall et al. | 340/854.3 |
| 2004/0159445 | A1 | 8/2004 | Hazel et al. | |
| 2004/0221997 | A1 * | 11/2004 | Giroux et al. | 166/380 |
| 2004/0248001 | A1 * | 12/2004 | Hall et al. | 429/176 |
| 2005/0028988 | A1 * | 2/2005 | Cook et al. | 166/380 |
| 2005/0045341 | A1 * | 3/2005 | Cook et al. | 166/380 |
| 2005/0070144 | A1 * | 3/2005 | Hall et al. | 439/191 |
| 2005/0121202 | A1 * | 6/2005 | Abercrombie Simpson et al. | 166/380 |
| 2005/0161226 | A1 * | 7/2005 | Duggan et al. | 166/380 |
| 2006/0027371 | A1 * | 2/2006 | Gorrara | 166/313 |
| 2006/0185855 | A1 * | 8/2006 | Jordan et al. | 166/380 |
| 2006/0225926 | A1 * | 10/2006 | Madhavan et al. | 175/320 |
| 2006/0266527 | A1 * | 11/2006 | Brisco et al. | 166/380 |
| 2007/0029095 | A1 * | 2/2007 | Brisco et al. | 166/380 |
| 2007/0119597 | A1 * | 5/2007 | McHardy et al. | 166/380 |
| 2008/0066929 | A1 * | 3/2008 | Costa et al. | 166/380 |
| 2008/0066930 | A1 * | 3/2008 | Costa et al. | 166/380 |
| 2008/0142229 | A1 * | 6/2008 | Brisco et al. | 166/380 |
| 2008/0156499 | A1 * | 7/2008 | Giroux et al. | 166/380 |
| 2009/0126944 | A1 * | 5/2009 | Noel, Jr. | 166/380 |
| 2009/0229836 | A1 * | 9/2009 | V | 166/380 |
| 2011/0005774 | A1 * | 1/2011 | Sinnott et al. | 166/380 |
| 2011/0011578 | A1 * | 1/2011 | Noel | 166/216 |

FOREIGN PATENT DOCUMENTS

| | | |
|---|---|---|
| WO | WO 01/04535 | 1/2001 |
| WO | WO 2005/102555 | 11/2005 |
| WO | WO 2006/038033 | 4/2006 |

* cited by examiner

EXPANDABLE LINER HANGER

FIELD OF THE INVENTION

The present invention relates to an apparatus and a method for extending the length of an existing tubular and an apparatus for sealing a tubular portion to another tubular. The apparatus and method are particularly suited for use in oil and gas wells.

BACKGROUND

Oil and gas wells are conventionally drilled using a drillstring to create a subterranean borehole. After drilling, the borehole is usually completed by running in a casing/liner string that is typically cemented in place. Additional liner strings may be required to be installed or coupled to the initially installed casing string in order to extend the reach of the completed borehole. This is conventionally achieved using liner hangers to couple additional liner strings to the lower end of the existing casing or liner string in the borehole. The liner hangers typically use mechanically or hydraulically set slips to bite into the existing casing. Furthermore, a packer is usually also used to provide a fluid tight seal at the location of the liner hanger to prevent fluid, in particular, gas ingress.

SUMMARY OF THE INVENTION

According to a first aspect of the invention, there is provided an apparatus for extending the length of an existing tubular, the apparatus comprising a tubular portion and a securing and sealing means for securing the tubular portion to the existing tubular to thereby extend the length of the existing tubular and simultaneously provide a sealed coupling between the tubular portion and the existing tubular.

The tubular portion is preferably radially expandable.

Preferably the apparatus provides a means to hang a new tubular portion, such as a liner string from a previously installed, existing tubular, such as cemented casing string or a cemented liner string and therefore acts as a liner hanger.

Part of the tubular portion can have a first sidewall thickness, which is less than a second sidewall thickness adjacent the part of the tubular having the first sidewall thickness.

The tubular portion can comprise a tapered part of tubular located between the parts of the tubular having the first wall thickness and the second wall thickness wherein the tapered part of the tubular portion has a wall thickness gradually increasing from the first sidewall thickness to the second sidewall thickness.

The diameter of the tubular portion can preferably be expanded by means of an expansion tool. The tubular portion can be radially expanded using a hydraulically operated expansion tool. The tool can be arranged to sealingly engage with an inner diameter of the tubular portion at two axially spaced locations. The tool can be arranged to engage with the inner diameter of the tubular portion in the region of the part of tubular having the second sidewall thickness on either side of the part of the tubular having the first wall thickness.

The tool can be capable of applying a fluid pressure within the tubular portion in the area between the points of engagement of the tool and the inner diameter of the tubular portion. The fluid pressure can cause the tubular portion to radially expand. The tubular portion can initially expand in the region of the first wall thickness, and subsequently in the region of the tapered part.

The tubular portion and the existing tubular may be expandable to form at least one shoulder portion. Two or more shoulder portions can be provided and the part of tubular therebetween can have a greater outer diameter than the tubular portion and existing tubular outwith the region between the shoulder portions. The tool can be arranged to radially expand the tubular portion and the existing tubular. The tool can be arranged to radially expand the tubular portion such that plastic deformation of the tubular portion is experienced. The tool can be arranged to radially expand the tubular portion into the existing tubular such that elastic deformation and optionally plastic deformation of the existing tubular is experienced. The expansion tool can create two annular shoulders in the region that the tool seals against the inner diameter of the tubular portion and the existing tubular. Preferably the tubular portion and the existing tubular are at least in part in interfacial contact in the region of each shoulder. This has the effect of securing the tubular portion to the existing tubular. The interfacial contact between the tubular portion and the existing tubular along the radially expandable part of the tubular preferably creates a fluid tight seal.

The tubular portion can have a substantially uniform outer diameter prior to expansion thereof.

The securing and sealing means can be provided on an outer surface of the tubular portion. The securing and sealing means could in certain embodiments be provided simply by the outer surface of the tubular portion. However, the securing and sealing means can preferably comprise a roughened part of the outer surface of the tubular portion to enhance the grip of the tubular portion on the pre-existing tubular. At least part of an outer surface of the tubular portion can be coated with an elastomeric material to aid sealing. The securing and sealing means can comprise at least one annular seal. The or each seal can be provided in an annular groove within the outer surface or on the outer surface of the tubular portion. The securing and sealing means can further comprise at least two axially spaced annular seals. Alternatively, or additionally, the securing and sealing means can comprise a profile applied to an outer surface of the tubular portion.

The or each seal can be provided on the outer surface of the tubular portion in the region of the tapered part with the gradually changing wall thickness.

According to the first aspect of the invention, there is provided a method of extending the length of an existing tubular, comprising the steps of:

- providing a tubular portion having a securing and sealing means; and
- simultaneously securing and sealing the tubular portion to the existing tubular and thereby extending the length of the existing tubular.

The method can include radially expanding at least a part of the tubular portion to secure and seal the tubular portion to the existing tubular.

The method can include running an expansion tool into the tubular portion and engaging the inner diameter of the tubular portion and expanding at least a part of the tubular portion using the expansion tool.

The method can include applying a fluid pressure within the tubular portion and thereby radially expanding at least part of the tubular portion.

The method can include radially expanding the tubular portion and the adjacent existing casing such that there is residual interfacial contact between the tubular portion and the existing tubular once the pressure is removed.

The method can include providing at least two axially spaced annular seals on an outer surface of the tubular portion and expanding part of the tubular portion between the seals and subsequently expanding the tubular portion in the region of the seals.

The method can include roughening at least a part of the outer surface of the tubular portion and thereby improving the grip of the tubular portion. The method can include machining a profile on an outer surface of the tubular portion to enhance the grip of the tubular portion on the existing tubular in use.

According to a second aspect of the invention, there is provided apparatus for securing a tubular portion to another tubular, the apparatus comprising a tubular portion having a first sidewall thickness and a second sidewall thickness, and having a tapered part therebetween wherein the second sidewall thickness is greater than the first sidewall thickness and the tapered part has a wall thickness gradually increasing from the first sidewall thickness to the second sidewall thickness.

Preferably, the apparatus further comprises a securing means provided on an outer surface of the tubular portion in the region of the tapered part. More preferably, the securing means comprises a securing and sealing means to provide a seal between the tubular portion and the existing tubular such that fluid is prevented from passing therebetween.

The tubular portion is preferably radially expandable. The tubular portion can have a substantially uniform outer diameter.

The part of tubular with the first sidewall thickness can have parts of tubular with the second sidewall thickness either side thereof and the tapered parts can be located therebetween. The securing means can be provided on the outer surface of the tubular portion in the region of each tapered part. The securing and/or sealing means could in certain embodiments be provided simply by the outer surface of the tubular portion. However, preferably, the tubular portion can be provided with an annular recess on the outer surface in the region of the or each tapered part, and the sealing means are preferably provided in the annular recess.

The apparatus can comprise a tool actuable to radially expand the tubular portion. The tool can be arranged to engage with an inner surface of the tubular in the region of the second sidewall thickness and can be actuable to apply a fluid pressure to the inner surface of the tubular portion. The fluid pressure can first cause radial expansion of the tubular portion having the first wall thickness followed by radial expansion of the tubular portion at the tapered part.

BRIEF DESCRIPTION OF THE DRAWINGS

Embodiments of the present invention will be described with reference to and as shown in the following Figures, in which.

DESCRIPTION OF THE PREFERRED EMBODIMENTS

Figure 1:
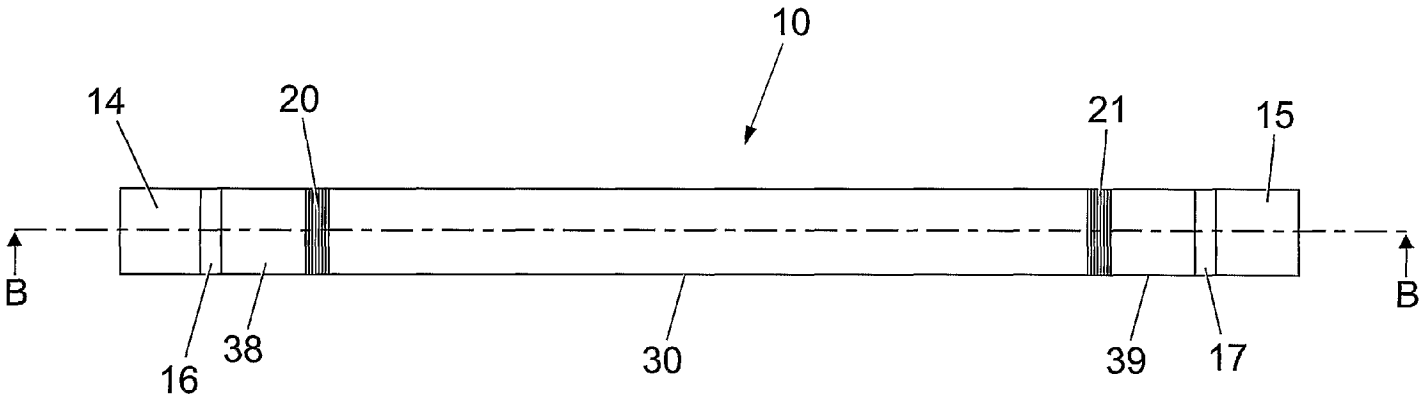
FIG. 1 is a side view of a liner hanger according to the present invention.

A tubular portion in the form of a liner hanger is shown generally at 10 in FIG. 1. The liner hanger 10 is a tubular having a throughbore 24 and comprising two outer parts 38, 39, two tapered parts 28, 29 located adjacent and inward of the outer parts 38, 39 and a central waisted part 30 provided therebetween. The central waisted part 30 has a first wall thickness, which is approximately 18 mm. The outer parts 38, 39 have a second wall thickness of approximately 24 mm, which is greater than the first sidewall thickness. The tapered parts 28, 29 provided therebetween have a wall thickness gradually increasing (preferably in a linear manner) from the first wall thickness to the second wall thickness.

Open ends of the outer parts 38, 39 of the liner hanger 10 are each welded to an end member 14, 15 respectively. The end members 14, 15 are attached to the outer parts 38, 39 respectively by butt welds 16, 17 or other such fixing method. According to one embodiment, the end members 14, 15 are formed from stronger materials than the rest of the liner hanger 10, enabling a casing thread to be cut in each end member 14, 15 and wherein the end members 14, 15 retain sufficient strength to achieve the desired connection torque ratings.

Figure 2:
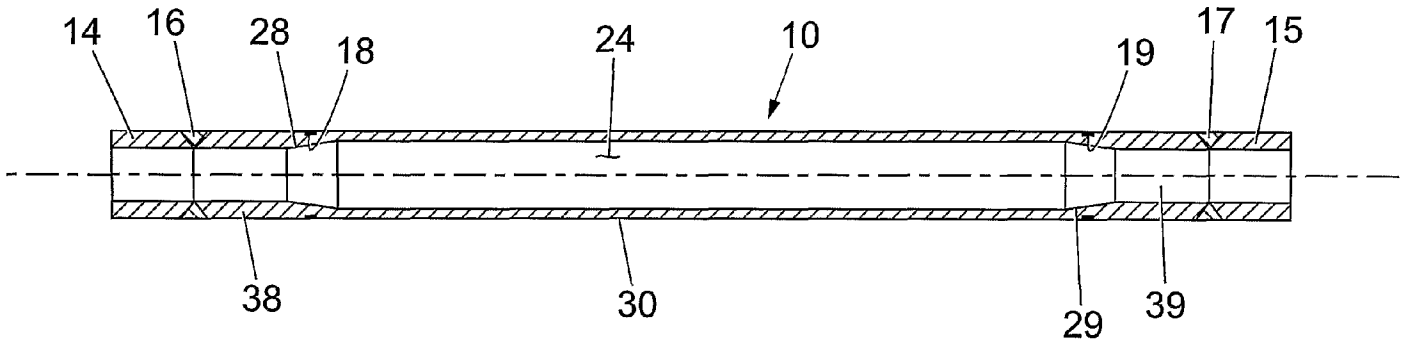
FIG. 2 is a sectional view of the liner hanger of FIG. 1 along the line B-B.
Figure 3:
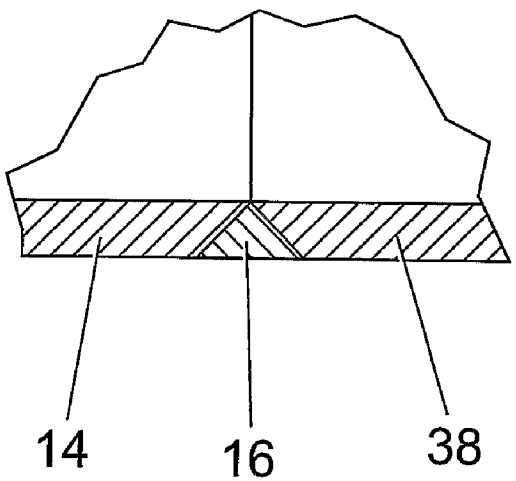
FIG. 3 is a detailed view of part C shown in FIG. 2.
Figure 4:
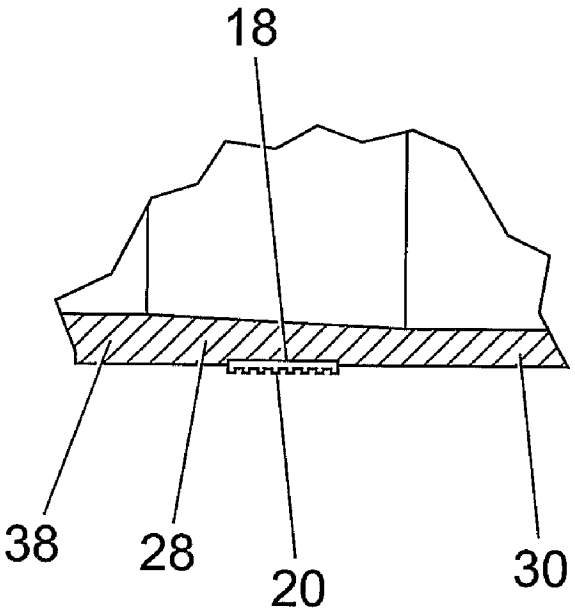
FIG. 4 is a detailed view of part D shown in FIG. 2.

An outer surface of the liner hanger 10 has a substantially uniform diameter. In order to provide a gas tight seal between the liner hanger 10 and the existing tubular into which it is to be expanded, the outer surface of the liner hanger 10 is provided with two annular grooves 18, 19 in the region of the tapered parts 28, 29 respectively as shown in FIGS. 2 and 4. Each groove 18, 19 accommodates an annular seal 20, 21. However, if for some reason a gas tight seal is not required, then the annular grooves 18, 19 can be omitted. The outer surface of the liner hanger 10 between the annular seals 20, 21 and in the region of the central waisted portion 30 preferably has a roughened surface to increase the contact friction between the two surfaces to thereby enhance the grip of the liner hanger 10, in use.

The liner hanger 10 is expandable using an expansion tool, such as that described in GB0403082.1 and corresponding foreign applications, the full contents of which are incorporated herein by reference. The tool is briefly described below with reference to FIGS. 7 to 10.

Figure 7:
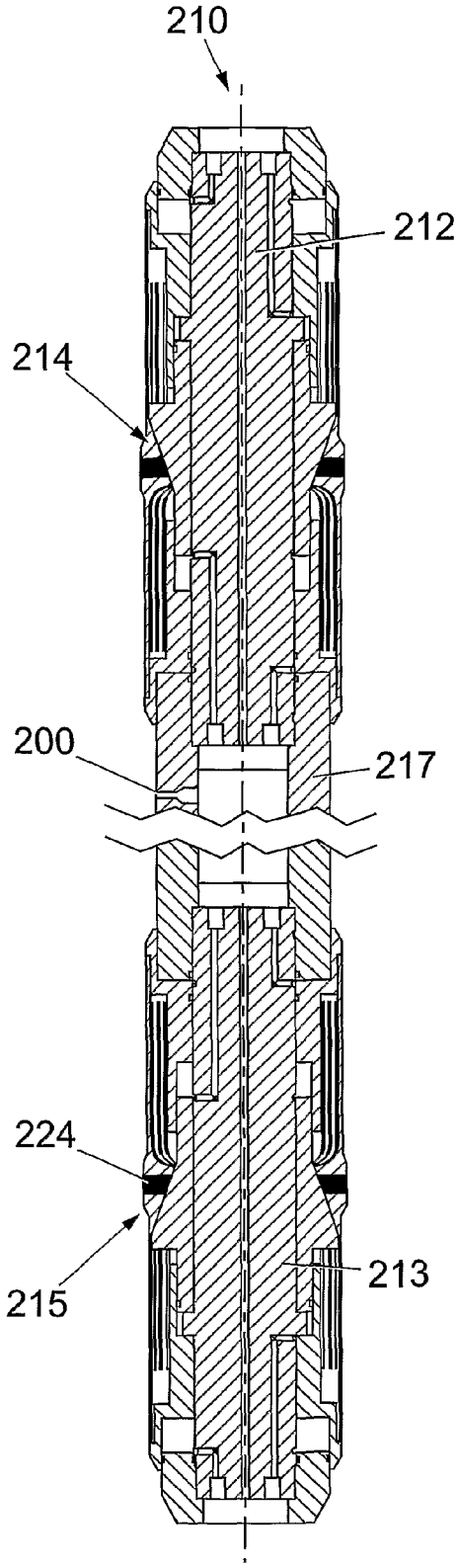
FIG. 7 is a sectional view of the expansion tool in the running position prior to actuation of the tool.
Figure 8:
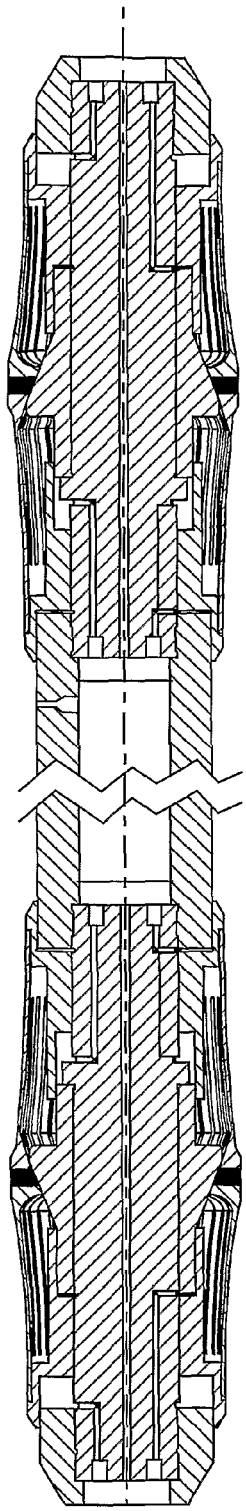
FIG. 8 is a sectional view of the tool of FIG. 7 in a setting configuration following actuation thereof.

FIGS. 7 and 8 show a hydraulic expansion tool 210 comprising a first upper inner element 212 that acts as a piston, a second lower inner element 213 that also acts as a piston, a first seal assembly 214 and a second seal assembly 215. The two inner elements 212, 213 are telescopically coupled to one another by means of a mandrel 217.

Figure 9:
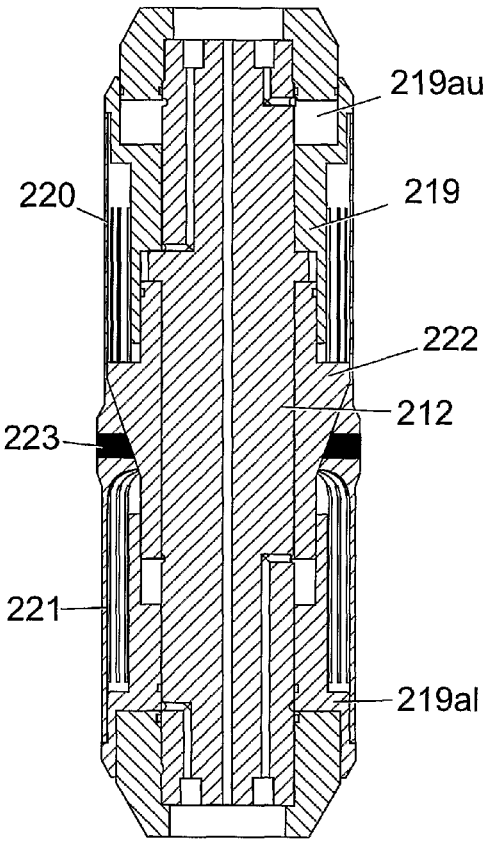
FIG. 9 is a detailed sectional view of a seal assembly of the expansion tool in the running position shown in FIG. 7.

The upper inner element 212 is shown in more detail in FIG. 9. The inner element 212 is generally cylindrical and comprises moveable connection means at both ends thereof for telescopic coupling to the mandrel 217 and other equipment. The inner element 212 also comprises a wedge member 222.

The seal assembly 214 (FIG. 7) is slidably disposed on the exterior of the inner element 212 and comprises an upper support sleeve 220, a lower support sleeve 221 and a seal 223. The support sleeves 220, 221 form expandable parts of the seal assembly 214 together with the seal 223 and preferably comprise fingers. The seal 223 comprises an annular expandable ring, preferably made from expandable or temperature resistant materials. A displacement means 219 is disposed between the seal assembly 214 and the inner element 212 (shown in FIGS. 9 and 10). The displacement means 219 operates to move the sliding seal assembly 214 relative to the inner element 212. Similarly the lower seal assembly 215 has a seal 224 and is moveable by a displacement means.

Figure 10:
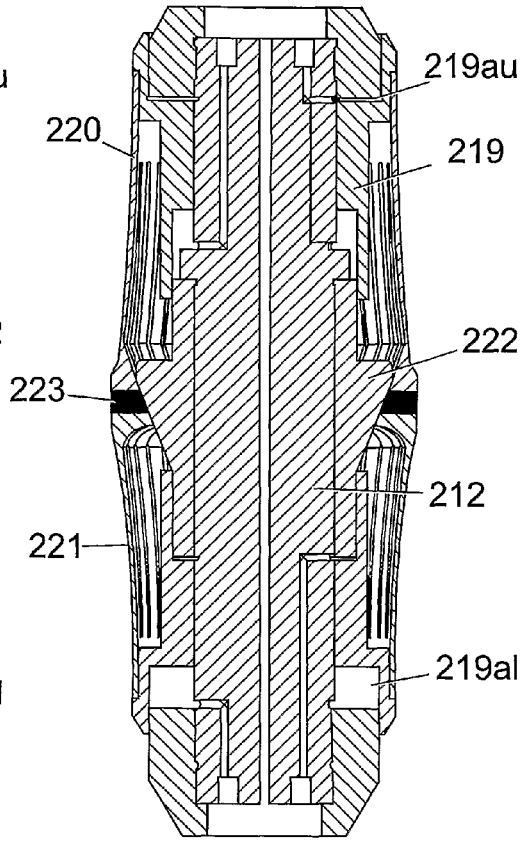
FIG. 10 is a detailed sectional view of a seal assembly of the tool in the setting configuration shown in FIG. 8.

The expansion tool 210 is hydraulically driven. The tool 210 shown in FIGS. 9 and 10 is provided with upper hydraulic fluid chambers 219*au* and lower hydraulic fluid chambers 219*al*, which are selectively pressurised with respective hydraulic fluid delivered from the surface via hydraulic lines (not shown). Thus, actuation of the seal assembly 214 occurs when pressurised fluid is forced into the chamber 219*a*1 to thereby force the inner element 212 downwards from the position shown in FIG. 9 to the position shown in FIG. 10, thus forcing the seal 223 to expand radially outwardly due to the action of the wedge member 222 thereupon.

Figure 5A:
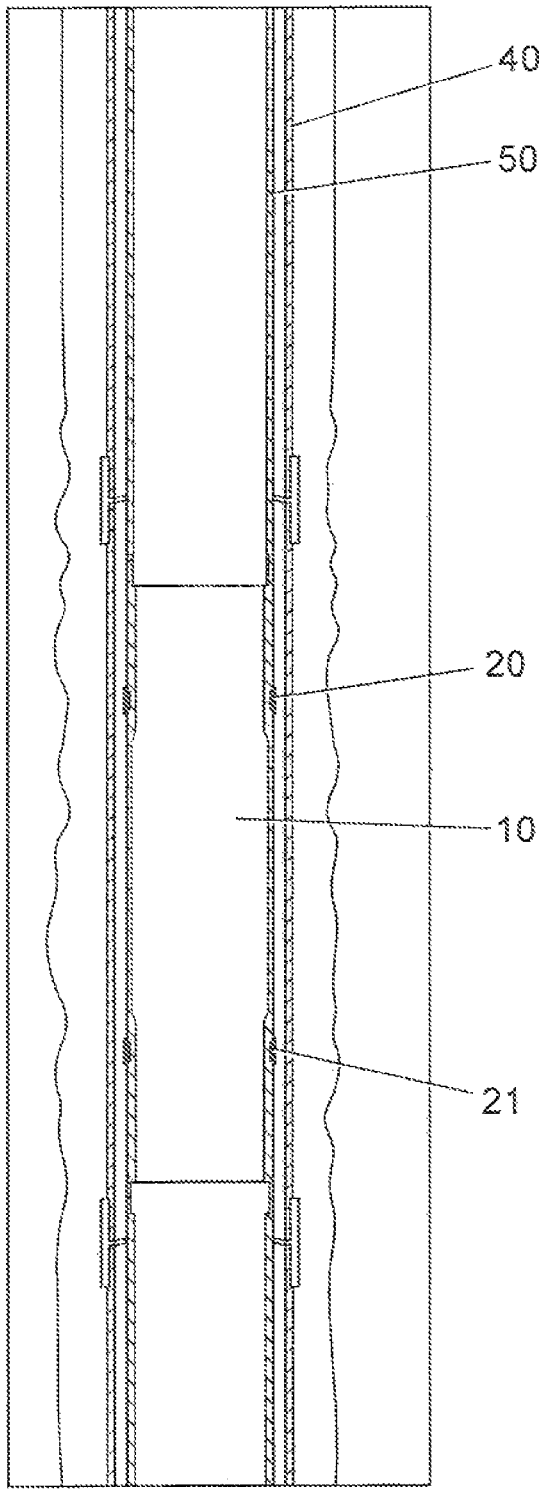
FIG. 5*a* is a sectional view of the liner hanger within a casing string.
Figure 5B:
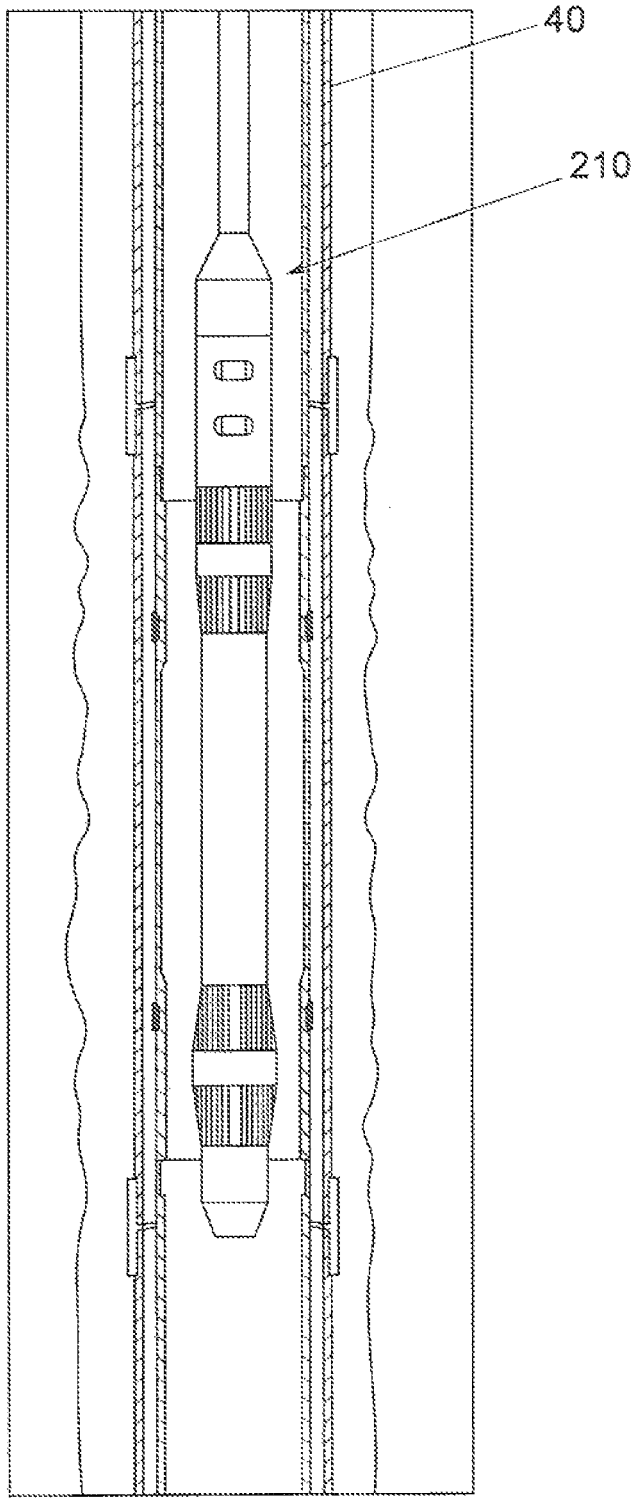
FIG. 5*b* is a part sectional view of the liner hanger and an expansion tool in a running-in configuration, being run into the throughbore of the casing string and liner hanger.

Before use of the apparatus according to the invention, a borehole is drilled out and a casing string 40 run-in and cemented in place as shown in FIG. 5*a*. The liner hanger 10 is connected, typically via threaded connections, to the upper end of a liner string 50 of similar outer diameter to the liner hanger 10 and having a smaller outer diameter than the inner diameter of the installed casing 40. Ata leading end of the liner string 50, a drill bit (not shown) is provided. The liner string 50 is run into the wellbore through the throughbore of the casing 40 and is rotated downhole or/and from surface such that the drill bit is used to extend the borehole further; this operation is known in the art as "drilling with casing" or "drilling with liner" or "casing while drilling". Drill fluid is circulated up the annulus between the outer diameter of the liner string 50 and the installed casing 40. Once the drill bit has reached its required depth drilling ceases, the drill bit and bottom hole assembly is retrieved, the casing 40 can be cemented in place and the liner hanger 10 is correctly positioned towards a lower end of the installed casing 40. The expansion tool 210 is run into the wellbore through the throughbore 24 of the liner string 50 in its running-in configuration as shown in FIGS. 5*b*, 7 and 9. The expansion tool 210 may be correctly positioned with respect to the liner hanger 10 using a depth latch system or a gamma ray tool with radioactive pip tags.

Figure 5C:
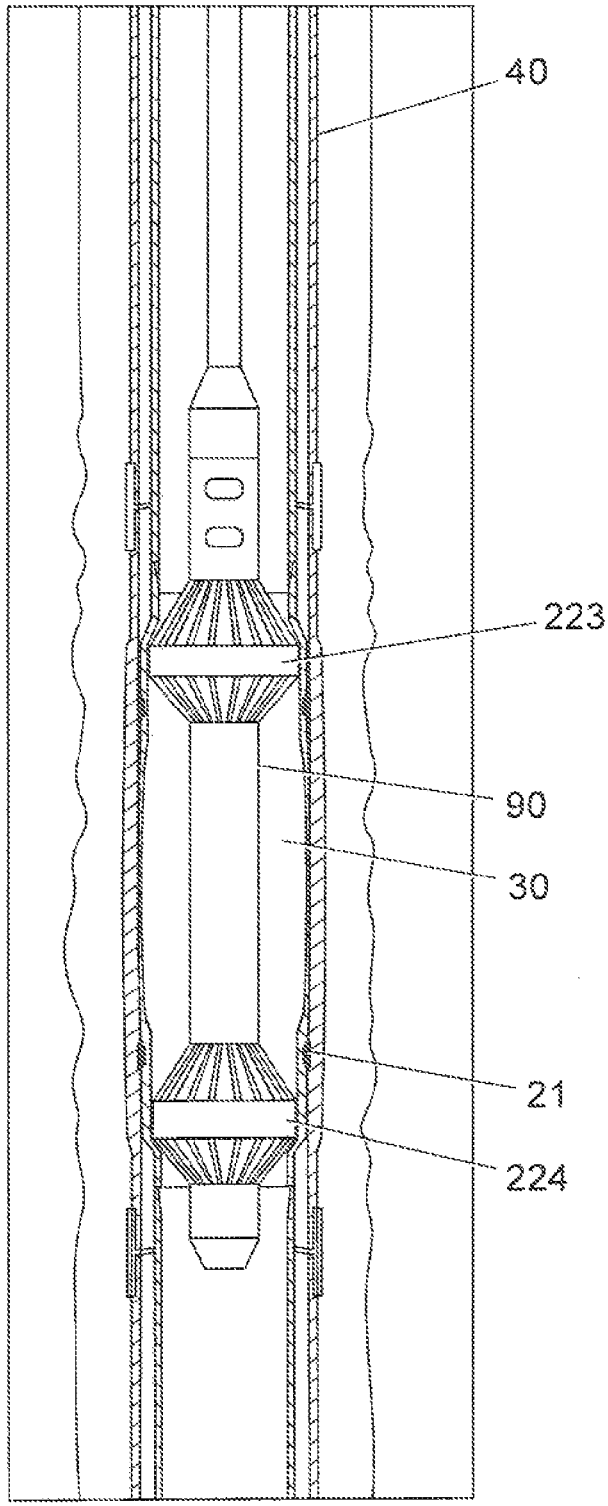
FIG. 5*c* is a part sectional view of the liner hanger being expanded by the expansion tool to thereby seal it to the casing string.

Once the expansion tool 210 reaches the liner hanger 10, the tool 210 is located such that the seals 223, 224 are adjacent the inner diameter of the outer parts 38, 39 respectively with the waisted central part 30 therebetween. The expansion tool 210 is hydraulically actuated. A compressive force is applied to the tool 210 using the displacement means 219. The compressive force causes a downwardly directed displacement of the support sleeve 220 and compression of the support sleeve 221. Consequently, the support sleeve 221 together with the annular seal 223 rises up the wedge member 222 which causes the annular seal 223 and the fingers of the support sleeves 220, 221 to expand radially. The expansion of the support sleeves 220, 221 and the corresponding movement of the lower seal assembly 215 is shown in FIGS. 5*c*, 8 and 10. In this way, the annular seals 223, 224 expand to a larger radius. Accordingly, the expansion of the seal assemblies 214, 215 causes the seals 223, 224 to engage with the outer parts 38, 39 and the seals 223, 224 are now in the setting position shown in FIGS. 5*c*, 8 and 10.

Once in the setting position, hydraulic fluid is directed under pressure from the surface to the tool 210 from where it is fed via a port 200 to an annulus 90 between the tool 210 and the liner hanger 10. The application of this fluid pressure on the inner surface of the liner hanger 10 causes radial expansion of the central waisted part 30 initially since the smaller sidewall thickness encourages this part of the liner hanger 10 to radially expand prior to the expansion of adjacent sections having greater wall thicknesses. Following expansion of the central waisted section 30, the tapered parts 28, 29 begin to expand. Throughout the liner hanger 10 expansion, the fingers of the support sleeves 220, 221 are activated at a pre-set pressure ahead of the pressure in the annulus 90. The pressure of fluid from the hydraulic source entering the annulus 90 is controlled via a differential pressure valve (not shown) to reduce the pressure from the hydraulic source. Hence, the pressure acting on the seal assemblies 215 is greater then the pressure of the annulus 90 by the predetermined amount e.g. 2000 psi so as to maintain the hydraulic seal without deforming the seal areas of the liner hanger 10 prior to the waisted central part 30 of the liner hanger 10.

One advantage of the initial expansion of the central waisted part 30 is that substantially all liquid between the outer surface of the liner hanger 10 and the casing 40, for example, water, oil and/or drilling mud or wet cement is squeezed out of the annulus between the liner hanger 10 and the casing 40 before the seals 20, 21 engage the inner surface of the casing 40. The securing of the liner hanger 10 to the casing 40 is aided by the roughened outer surface of the central waisted part 30 to engage a greater proportion of surface area into contact with the inner surface of the casing 40.

The positioning of the seals 20, 21 of the liner hanger 10 in the region of the tapered parts 28, 29 has the added advantage that the annular grooves 18, 19 on the outer surface of the liner hanger 10 (which accommodate the seals 20, 21) are not located in the region of liner hanger with the smallest sidewall thickness and therefore the location of the seals 20, 21 does not represent a weak point of the liner hanger 10. However, the outer surface in the region of the smallest sidewall thickness may also or alternatively be coated in a sealing elastomer or such similar material to aid sealing.

The liner hanger 10 is expanded beyond its elastic limit such that plastic deformation of the liner hanger 10 is experienced. The force applied by the hydraulic fluid to the liner hanger 10 is such that there is a strong interfacial contact between the casing 40 and the liner hanger 10. As a result of continued application of fluid pressure, elastic deformation of the casing 40 is experienced. The elastic and plastic deformation of the casing 40 and the liner hanger 10 respectively causes a compressive force to be applied by the casing 40 to the liner hanger 10 thus improving the quality and strength of the interfacial seal. Deformation of the liner hanger 10 beyond its elastic limit ensures that the radially expanded liner hanger 10 remains in its radially expanded state once the hydraulic fluid pressure is removed. Thus, according to the preferred embodiment, the liner hanger 10 is expanded beyond its elastic limit to experience plastic deformation and the casing 40 is expanded up to its elastic limit but not beyond so that no plastic deformation of the casing 40 is experienced.

Once the liner hanger 10 has been secured to the casing 40, the compressive force on the displacement means 219 is reduced by relieving the pressure in the chambers 219*a*1 and increasing the pressure in chambers 219*au* to cause the inner element 212 to move upwardly into the position shown in FIG. 9. As the annular seal 223 slides down the wedge member 222, the radius of the seal 223 decreases and the fingers of the sleeves 220, 221 return to their original positions. Similarly, the seal 224 is retracted and thus, the expansion tool 210 is in its initial running-in configuration and can be pulled out of the wellbore.

According to another embodiment, both the liner hanger 10 and the casing 40 are expanded to create upper and lower annular shoulders to enhance the load capability of the liner hanger 10; these are shown in more detail and described with reference to FIG. 6.

Figure 6:
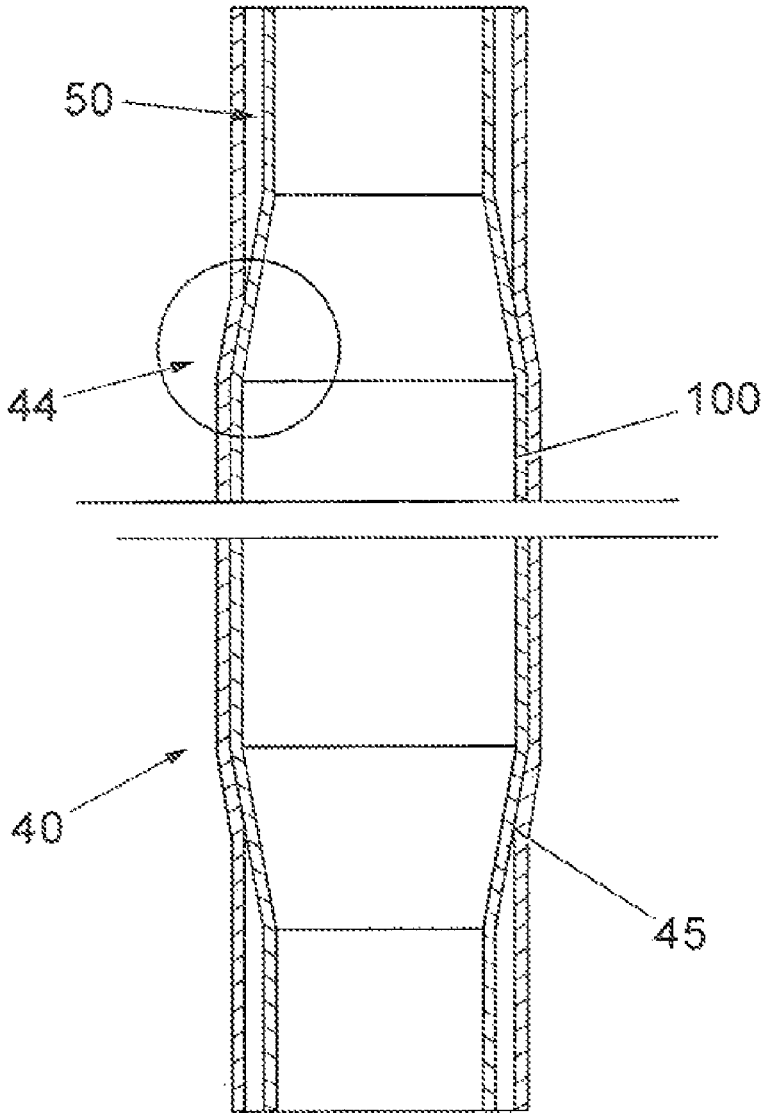
FIG. 6 is a sectional view of apparatus according to another embodiment of the invention.

An alternative liner hanger 100 is shown in FIG. 6 expanded into contact with the casing 40. The liner hanger 100 differs from the liner hanger 10 described for the previous embodiment in that no elastomeric seals are provided on an outer surface thereof. Optionally, the liner hanger 100 has parts having a greater sidewall thickness either side of a central waisted portion and tapered parts therebetween; the benefits of which were outlined with reference to the first described embodiment.

In FIG. 6, the liner hanger 100 has been expanded in the manner previously described to form a metal to metal seal. The plastic deformation of both the liner hanger 100 and the casing 40 results in the formation of an upper shoulder portion 44 and a lower shoulder portion 45 in the region of the respective seals 223, 224 of the expansion tool 210, at the outer extremity of the expanded part of the liner hanger 100. The shoulder portions 44, 45 have the advantage of enhancing the load capability of the liner hanger 100.

The apparatus and the method of the present invention provide a way of securing and sealing a liner hanger to existing casing without the need for slips or moving parts and is achievable in a one step process.

Modifications and improvements can be made without departing from the scope of the invention. According to other embodiments of the invention, any number of annular seals 20, 21 can be provided in one or more annular grooves.

The invention claimed is:

1. A tubular portion apparatus for securing and sealing to an existing wellbore tubular in an oil or gas well, the apparatus comprising:

a first sidewall thickness part having a first sidewall thickness and a fully circular outer surface;

a second sidewall thickness part having a second sidewall thickness, wherein the second sidewall thickness part is located at each end of the first sidewall thickness part; and a tapered part located between each end of the first sidewall thickness part and the respective second sidewall thickness part;

wherein the first sidewall thickness is less than the second sidewall thickness; and the tapered part has a wall thickness gradually increasing from the first sidewall thickness to the second sidewall thickness; and at least one annular seal provided on the outer surface of the tubular portion in a region of the respective tapered part;

wherein, in use, the tubular portion is radially expanded whereby the first sidewall thickness part is expanded prior to the expansion of the second sidewall thickness part upon pressurised fluid being applied to an interior of the tubular portion, and wherein the tubular portion comprises a substantially uniform outer diameter prior to expansion thereof.

2. An apparatus according to claim 1, wherein the apparatus provides a means to hang a new tubular portion, from a previously installed, existing tubular, such that the apparatus provides a liner hanger.

3. An apparatus according to claim 1, wherein the tubular portion is expandable by means of a hydraulically operated expansion tool.

4. An apparatus according to claim 3, wherein the expansion tool is arranged to sealingly engage with an inner diameter of the tubular portion at two axially spaced locations.

5. An apparatus according to claim 4, wherein the expansion tool is arranged to engage with the inner diameter of the tubular portion in a region of the second sidewall thickness part.

6. An apparatus according to claim 5, wherein the expansion tool is arranged to engage with the inner diameter of the tubular portion in the region of the second sidewall thickness part of the tubular on either side of the first sidewall thickness part of the tubular.

7. An apparatus according to claim 4, wherein the expansion tool is adapted to engage with the inner diameter of the tubular portion at spaced apart points on the tubular portion and is capable of applying a fluid pressure within the tubular portion in the area between the spaced apart points and the inner diameter of the tubular portion.

8. An apparatus according to claim 1, wherein the tubular portion is adapted to initially expand in a region of the first wall thickness, and subsequently in the region of the tapered part.

9. An apparatus according to claim 1, wherein the tubular portion and the existing tubular are expandable to form at least one shoulder portion.

10. An apparatus according to claim 9, wherein two or more shoulder portions are provided and the part of tubular therebetween comprises a greater outer diameter than the tubular portion and existing tubular outwith a region between the shoulder portions.

11. An apparatus according to claim 1, wherein the at least one annular seal is provided in an annular groove within or on the outer surface of the tubular portion.

12. An apparatus according to claim 1, wherein the first sidewall thickness part comprises a substantially uniform inner diameter prior to expansion thereof.

13. An apparatus according to claim 1, wherein the tubular portion includes an inner diameter surface, the first sidewall thickness being defined by the spacing between the outer diameter surface and the inner diameter surface; and wherein the outer diameter surface and inner diameter surface are substantially concentric along a length of the tubular extending over the first and second sidewall thickness parts.

14. An apparatus according to claim 13, wherein the inner diameter surface is substantially circular along an entire length of the tubular.

15. A method of securing and sealing a tubular portion to an existing wellbore tubular in an oil or gas well, comprising the steps of:

providing a tubular portion having a securing and sealing means comprising at least two axially spaced annular seals on an outer surface of the tubular portion;

running an expansion tool into the tubular portion; and engaging an inner diameter of the tubular portion with the expansion tool; applying pressurised fluid within the tubular portion via the expansion tool and thereby initially radially expanding the tubular portion between the seals and subsequently radially expanding the tubular portion in a region of the seals using the expansion tool to simultaneously secure and seal the tubular portion within the existing tubular, wherein the tubular portion comprises:

a first sidewall thickness part having a first sidewall thickness and a fully circular outer surface;

a second sidewall thickness part having a second sidewall thickness, wherein the second sidewall thickness part is located at each end of the first sidewall thickness part; and a tapered part located between each end of the first sidewall thickness part and the respective second sidewall thickness part;

wherein the first sidewall thickness is less than the second sidewall thickness; and the tapered part has a wall thickness gradually increasing from the first sidewall thickness to the second sidewall thickness; and said at least one annular seal is provided on the outer surface of the tubular portion in a region of the respective tapered part.

16. A method according to claim 15, wherein the method further comprises radially expanding the tubular portion and the adjacent existing tubular such that there is residual interfacial contact between the tubular portion and the existing tubular once the pressure is removed.

17. A method according to claim 15, wherein the method further comprises roughening at least a part of the outer surface of the tubular portion such that the securing and sealing of the tubular portion within the existing tubular, in use, is thereby improved.

18. A method according to claim 15, wherein the method further comprises machining a profile on an outer surface of the tubular portion to enhance the securing and sealing of the tubular portion within the existing tubular in use.

19. An apparatus according to claim 15, wherein the tubular portion includes an inner diameter surface, the first sidewall thickness being defined by the spacing between the outer diameter surface and the inner diameter surface; and wherein the outer diameter surface and inner diameter surface are substantially concentric along a length of the tubular extending over the first and second sidewall thickness parts.

20. An apparatus according to claim 19, wherein the inner diameter surface is substantially circular along an entire length of the tubular.

21. A tubular portion apparatus for securing and sealing a tubular portion to a second tubular in an oil or gas well, the apparatus comprising:

a tubular portion having an inner and outer surface and having a first part having two axially spaced apart ends and having a first sidewall thickness and a fully circular outer surface; and a second part located at each end of the first part, each second part having a second sidewall thickness, and the tubular portion having a tapered part located between the first part and each of the second parts, wherein the second sidewall thickness is greater than the first sidewall thickness and the tapered part has a wall thickness gradually increasing from the first sidewall thickness to the second sidewall thickness, and having at least one annular seal provided on the outer surface of the tubular portion in the region of each tapered part, and wherein, in use, the tubular portion is radially expanded whereby the first part of the tubular portion between the second parts is expanded prior to the expansion of the second parts upon pressurised fluid being applied to the interior of the tubular portion; and wherein the tubular portion comprises a substantially uniform outer diameter prior to expansion thereof.

22. An apparatus according to 21, wherein the annular seal provides a seal between the tubular portion and the existing tubular such that fluid is prevented from passing therebetween.

23. An apparatus according to claim 21, wherein the first part comprises a substantially uniform inner diameter prior to expansion thereof.

24. An apparatus according to claim 21, wherein the tubular portion comprises an annular recess on the outer surface in a region of each tapered part, and the annular seals are provided in the annular recesses.

25. An apparatus according to claim 21, wherein the outer and inner surfaces of the tubular portion are substantially concentric along a length of the tubular extending over the first part and second part.

26. A tubular portion apparatus adapted to be secured and sealed to another tubular, the tubular portion comprising:

a first sidewall thickness part having a first sidewall thickness and a fully circular outer surface;

a second sidewall thickness part having a second sidewall thickness, wherein the second sidewall thickness part is located at each end of the first sidewall thickness part; and a tapered part located between each end of the first sidewall thickness part and the respective second sidewall thickness part;

wherein the first sidewall thickness is less than the second sidewall thickness; and the tapered part has a wall thickness gradually increasing from the first sidewall thickness to the second sidewall thickness; and at least one annular seal is provided on an outer surface of the tubular portion in a region of the respective tapered part;

wherein, in use, the tubular portion is radially expanded whereby the first sidewall thickness part is expanded prior to the expansion of the second sidewall thickness part upon pressurised fluid being applied to the an interior of the tubular portion, and wherein the tubular portion comprises a substantially uniform outer diameter prior to expansion thereof.

27. An apparatus according to claim 26, wherein the tubular portion is adapted to be secured and sealed within the said tubular and simultaneously provides a sealed coupling between the tubular portion and the said tubular.

28. An apparatus according to claim 26, wherein the apparatus provides a means to hang a new tubular portion, from a previously installed, existing tubular, such that the apparatus provides a liner hanger.

29. An apparatus according to any of claims 26, wherein the tubular portion is expandable by means of an expansion tool, wherein the diameter of the tubular portion is expandable by means of a hydraulically operated expansion tool, wherein the expansion tool is arranged to sealingly engage with an inner diameter of the tubular portion at two axially spaced locations, said locations being the inner diameter of the tubular portion in a region of the second sidewall thickness part, wherein the expansion tool is capable of applying a fluid pressure within the tubular portion in the area between the points of engagement of the expansion tool and an inner diameter of the tubular portion; wherein the fluid pressure causes the tubular portion to radially expand.

30. An apparatus according to any of claims 26, wherein the tubular portion is adapted to initially expand in a region of the first sidewall thickness part, and subsequently in the region of the respective tapered part.

31. An apparatus according to any of claims 26, wherein the or each seal is provided in an annular groove within or on the outer surface of the tubular portion.

32. An apparatus according to claim 26, wherein the tubular portion includes an inner diameter surface, the first sidewall thickness being defined by the spacing between the outer diameter surface and the inner diameter surface; and wherein the outer diameter surface and inner diameter surface are substantially concentric along a length of the tubular extending over the first and second sidewall thickness parts, and wherein the inner diameter surface is substantially circular along an entire length of the tubular.

33. A method of securing and sealing a tubular portion to another tubular, comprising the steps of:

providing a tubular portion having a securing and sealing means comprising at least two axially spaced annular seals on an outer surface of the tubular portion;

running an expansion tool into the tubular portion; and engaging an inner diameter of the tubular portion with the expansion tool;

applying pressurised fluid within the tubular portion via the expansion tool and thereby initially radially expanding the tubular portion between the seals and subsequently radially expanding the tubular portion in a region of the seals using the expansion tool to simultaneously secure and seal the tubular portion within the said another tubular, wherein the tubular portion comprises:

a first sidewall thickness part having a first sidewall thickness and a fully circular outer surface;

a second sidewall thickness part having a second sidewall thickness, wherein the second sidewall thickness part is located at each end of the first sidewall thickness part; and a tapered part located between each end of the first sidewall thickness part and the respective second sidewall thickness part;

wherein the first sidewall thickness is less than the second sidewall thickness; and the tapered part has a wall thickness gradually increasing from the first sidewall thickness to the second sidewall thickness; and said at least one annular seal is provided on the outer surface of the tubular portion in a region of the respective tapered part.

34. A method according to claim 33, wherein the method simultaneously provides a sealed coupling between the tubular portion and the said tubular, thereby providing a method of hanging a new tubular portion, from a previously installed, existing tubular, such that a liner hanger is provided.

35. A method according to claims 33, wherein the method further comprises radially expanding the tubular portion and the said another tubular such that there is residual interfacial contact between the tubular portion and the said another tubular once the pressure is removed.

36. A method according to claim 33, wherein the expansion tool is arranged to sealingly engage with an inner diameter of the tubular portion at two axially spaced locations, said locations being the inner diameter of the tubular portion in a region of the second sidewall thickness part.

37. A method according to any of claims 33, wherein the tubular portion comprises a first sidewall section;

a second sidewall section located at each end of the first sidewall section; and wherein the first sidewall section is adapted to ensure that it radially expands prior to the expansion of the second sidewall section.

38. A method according to claim 37, wherein the initial expansion of the first sidewall section squeezes substantially all liquid between the outer surface of the tubular portion and the other tubular prior to the at least two seals engaging an inner surface of the said another tubular.

* * * * *